US010696469B2

(12) United States Patent
Hallam et al.

(10) Patent No.: US 10,696,469 B2
(45) Date of Patent: Jun. 30, 2020

(54) COMPRESSED TISSUE CARTON

(75) Inventors: James Alexander Hallam, London (GB); Dennis Edward Fryer, Ashford (GB); Martin Christopher Bunce, Pewsey (GB); Peter Booth, Savernake (GB); James Mallion, Swindon (GB)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 13/040,455

(22) Filed: Mar. 4, 2011

(65) Prior Publication Data

US 2012/0223092 A1 Sep. 6, 2012

(51) Int. Cl.

| | |
|---|---|
| ***B65D 83/08*** | (2006.01) |
| ***B65D 83/00*** | (2006.01) |
| ***B65H 1/00*** | (2006.01) |
| *B65D 85/07* | (2017.01) |

(52) U.S. Cl.

CPC ..... *B65D 83/0805* (2013.01); *B65D 85/07* (2018.01)

(58) Field of Classification Search

USPC ..... 221/30–33, 47–49, 53, 54, 63, 302–304, 221/306, 207, 209

See application file for complete search history.

(56) References Cited

U.S. PATENT DOCUMENTS

| | | | | |
|---|---|---|---|---|
| 1,628,981 A * | 5/1927 | Horwitt | B65D 83/0805 206/772 | |
| 2,672,233 A * | 3/1954 | Baxter | 221/48 | |
| 3,172,563 A * | 3/1965 | Harwood | 221/48 | |
| 3,197,062 A | 7/1965 | Day et al. | | |
| 3,239,097 A | 3/1966 | Bates et al. | | |
| 3,263,807 A | 8/1966 | Fingerhut | | |
| 3,325,003 A | 6/1967 | Bilezerian | | |
| 3,379,364 A | 4/1968 | Pilger | | |
| 3,576,243 A * | 4/1971 | Trunick | 221/63 | |
| 3,684,086 A | 8/1972 | Harrison | | |
| 3,970,215 A | 7/1976 | McLaren et al. | | |
| 3,979,019 A | 9/1976 | Bliss | | |
| 4,790,436 A | 12/1988 | Nakamura | | |
| 4,836,410 A | 6/1989 | Mastrobuoni | | |
| 4,944,405 A | 7/1990 | Buford et al. | | |
| 5,016,753 A | 5/1991 | Henderson | | |
| 5,145,091 A | 9/1992 | Meyers | | |
| 5,219,421 A | 6/1993 | Tipping | | |

(Continued)

FOREIGN PATENT DOCUMENTS

| | | |
|---|---|---|
| DE | 1261439 B | 2/1968 |
| DE | 202 00 700 U1 | 8/2007 |

(Continued)

*Primary Examiner* — Gene O Crawford
*Assistant Examiner* — Kelvin L Randall, Jr.
(74) *Attorney, Agent, or Firm* — Kimberly-Clark Worldwide, Inc.

(57) ABSTRACT

Generally, the present disclosure relates to a carton for dispensing compressed tissue sheets comprising a carton having an oversized carton opening and a compressed stack of tissues, such as facial tissues. The compressed carton can significantly reduce costs associated with shipping such low density products. The oversized carton opening permits the compressed stack of tissues to expand, releasing the compression of the tissue stack and allowing the tissues to be dispensed normally.

15 Claims, 3 Drawing Sheets

(56) References Cited

U.S. PATENT DOCUMENTS 5,507,130 A 4/1996 Young et al.
5,535,887 A 7/1996 Young et al.
5,540,354 A 7/1996 Annand
5,642,602 A 7/1997 Young et al.
5,666,786 A 9/1997 Focke et al.
5,704,480 A 1/1998 Scholz et al.
5,857,311 A 1/1999 Focke et al.
6,065,591 A 5/2000 Dill et al.
6,102,277 A 8/2000 Krapohl, Sr.
6,409,044 B1 6/2002 Brown et al.
6,474,542 B1 11/2002 Chagnon et al.
6,672,475 B1 1/2004 Ho et al.
6,817,484 B2 11/2004 Morin et al.
7,571,832 B2 8/2009 Mark et al.
7,661,554 B2 * 2/2010 Szymonski ..... B65B 25/141 221/33
7,886,933 B2 * 2/2011 Hirasawa et al. ..... 221/302
8,033,421 B2 * 10/2011 Cowell ..... B65D 83/0805 206/37
8,205,748 B2 * 6/2012 Long et al. ..... 206/494
8,210,393 B1 * 7/2012 Nasrallah ..... 221/54
2003/0155264 A1 * 8/2003 Morin ..... 206/494
2003/0168467 A1 * 9/2003 Thoms ..... 221/48
2003/0205613 A1 * 11/2003 Schliebner ..... B65D 5/4245 229/118
2005/0150801 A1 * 7/2005 Tippey ..... B65D 5/68 206/440
2005/0269343 A1 * 12/2005 Gao et al. ..... 221/63
2007/0235467 A1 * 10/2007 Heitmann ..... A47K 10/421 221/38
2008/0054012 A1 3/2008 Long
2008/0061120 A1 3/2008 Nowak et al.
2008/0128451 A1 * 6/2008 Krauth ..... B65D 43/169 221/63
2008/0257903 A1 10/2008 Hirasawa et al.
2009/0090736 A1 * 4/2009 Cowell ..... B65D 83/0805 221/45
2009/0289077 A1 * 11/2009 Melin ..... A47K 10/421 221/45
2009/0289078 A1 * 11/2009 Melin ..... A47K 10/421 221/45
2010/0019022 A1 * 1/2010 Ryan ..... B65D 5/563 229/122
2010/0078444 A1 4/2010 Shannon et al.
2010/0102077 A1 4/2010 Szymonski et al.
2011/0129633 A1 6/2011 Andersson

FOREIGN PATENT DOCUMENTS

DE 202007005536 U1 8/2007
EP 1607033 A1 12/2005
FR 2 914 281 A1 10/2008
GB 2163131 A 2/1986
JP 49-090581 U 8/1974
JP 59-112775 U 7/1984
JP 59-181075 U 12/1984
JP 01-182280 A 7/1989
JP 3009515 U 4/1995
JP 07-315458 A 12/1995
JP 09-140623 A 6/1997
JP 09-140624 A 6/1997
JP 10-290763 A 11/1998
JP 2001-340257 A 12/2001
JP 2002-308352 A 10/2002
JP 2004-026294 A 1/2004
JP 2006-298416 A 11/2006
JP 2009-165763 A 7/2009
JP 2010-047270 A 3/2010
KR 10-2008-0009791 A 1/2008
KR 20080009791 A 1/2008

* cited by examiner

COMPRESSED TISSUE CARTON

FIELD OF THE INVENTION

This disclosure relates to a tissue carton comprising a stack of compressed tissues. Various compressed tissue cartons are disclosed. By providing a carton with an oversized carton opening it has been discovered that the compressed stack of tissues may be dispensed normally by a user.

BACKGROUND

When shipping folded tissue products, such as cartons of facial tissues, a significant portion of the transportation costs incurred are due to shipping air because of the low density of the tissues. Consequently, when shipping by truck, for example, the volume capacity of the truck is reached before the weight capacity. Also, on the retailers' shelves, the bulkiness of the tissue products consumes shelf space and therefore limits the number of items the retailers can stock. Unfortunately, placing more tissues into a given carton to increase shipping cost efficiency and/or reduce consumption of retail shelf space creates compression within the stack of tissues and thereby makes it difficult for the user to remove the first few tissues from the carton without tearing them.

While the retailer often desires products which use less shelf space, there are disadvantages to using compressed or concentrated products. For example, one disadvantage is that compressed tissue stacks dispense poorly when packaged in traditional flat tissue cartons. Therefore, there is a need for tissue products that can be shipped more economically without sacrificing ease of dispensing or presence of the product on the retailer's shelf.

SUMMARY

It has now been surprisingly discovered that compressed tissues may be dispensed with ease by packaging the tissues in a carton having an oversized carton opening. The preferred carton opening size is generally from about 110 percent to about 275 percent greater than the opening size found on traditional, non-compressed tissue cartons. Thus, in a preferred embodiment the present disclosure provides a carton for dispensing a compressed stack of tissues, the carton comprising a carton opening located on a top panel, the area of the carton opening comprising from about 50 to about 85 percent of the area of the top panel. In this preferred embodiment, tissues may be compressed significantly, reducing the overall height of the carton, without negatively impacting ease of dispensing.

In other embodiment the present disclosure provides carton comprising a top panel; a first and a second sidewall; a carton opening located in the top panel; and a dispensing window covering at least a portion of the carton opening; wherein the area of the carton opening is from about 50 percent to about 85 percent of the area of the top panel.

In still other embodiments the present disclosure provides A carton for dispensing a compressed stack of tissues comprising a top panel; a carton opening disposed on the top panel, the carton opening having an area that is from about 50 percent to about 85 percent of the area of the top panel; a pair of side panels; a dispensing window covering at least a portion of the carton opening and a portion of at least one side panel; a dispensing opening disposed on the dispensing window; a removable surfboard overlaying at least a portion of the dispensing window; a compressed stack of tissues; and a bottom panel.

In other embodiments the present disclosure provides a carton for dispensing compressed interfolded disposable sheets comprising a dispensing carton configured to house a stack of compressed interfolded disposable sheets and having a plurality of sides defining an interior space, the carton having a carton opening disposed on at least one side, wherein the area of the carton opening is from about 50 percent to 85 percent of the area of the side on which it is disposed.

In yet other embodiments the present disclosure provides a method of making a carton of compressed tissues comprising the steps of providing a dispensing carton having a top panel and a carton opening disposed thereon, wherein the ratio of the area of the top panel to the area of the carton opening is from about 50 to about 85 percent; compressing a stack of tissue sheets; and inserting the compressed stack of tissue sheets into the dispensing carton, whereby the stack of tissue sheets is constrained within the expandable dispensing carton in a compressed condition.

DEFINITIONS

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As used herein, "tissue" generally refers to various paper products, such as facial tissue, bath tissue, paper towels, napkins, and the like. Normally, the basis weight of a tissue product of the present disclosure is less than about 80 grams per square meter (gsm), in some embodiments less than about 60 gsm, and in some embodiments, between about 10 to about 60 gsm.

As used herein the term "carton opening" generally refers to an opening formed in one or more walls of a carton.

As used herein the term "dispensing opening" generally refers to an opening through which tissues are dispensed such as, for example, an opening formed in a material covering a portion of the carton opening.

DETAILED DESCRIPTION

Generally, the present disclosure relates to a carton for dispensing compressed tissues. By enlarging the size of the dispensing opening, it has been discovered that the compressed tissues may be dispensed with ease. In addition, by extending the dispensing window along at least one of the sidewalls of the carton, dispensing of the compressed tissues may be improved. Thus, the carton of the present disclosure provides dispensing comparable to non-compressed tissue containers, while providing tissues in a compressed or concentrated product form that requires less shelf space.

Figure 1:
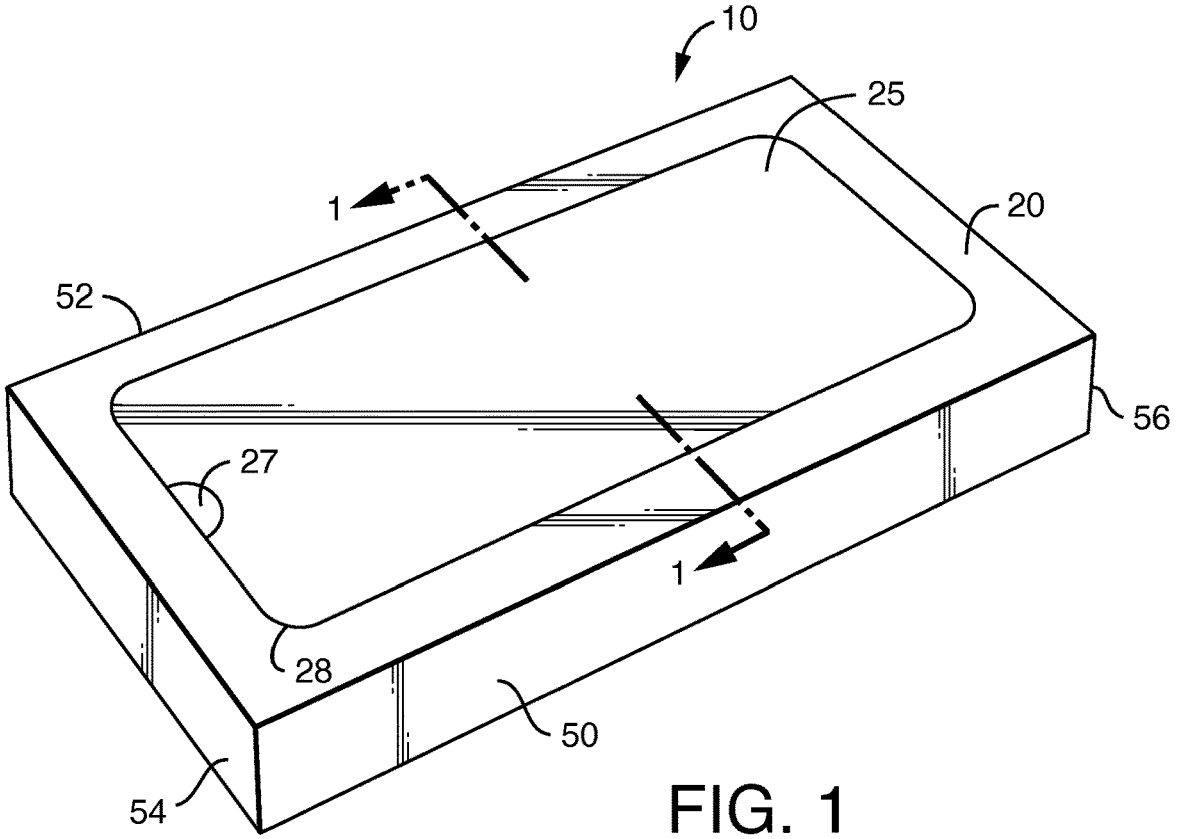
FIG. 1 illustrates a tissue carton dispenser according to one embodiment of the present disclosure.

Now with reference to FIG. 1 which illustrates one embodiment of a compressed tissue carton of the present disclosure in a form suitable for shipping. As shown in FIG. 1, the carton 10 comprises a top panel 20, first 50 and second (not shown) sidewalls, opposing first 54 and second (not shown) end panels, a bottom panel (not shown), a carton opening 30, and a surfboard 25 covering at least a portion of the dispensing opening. The surfboard 25 may be present on the top panel 20 (such as represented by the rectangular perforation in FIG. 1). Such surfboards are a common feature of current commercially available tissue cartons. In certain embodiments the surfboard may be attached to a cut out section in the dispensing window to allow for a larger dispensing opening. In certain embodiments, to further facilitate dispensing of the first sheet, the surfboard may be attached to the top sheet of the tissue stack such that when the surfboard is removed by a user the top sheet is dispensed. As further illustrated in FIG. 1 the surfboard 25 may also comprises a finger tab 27 to facilitate removal by a user.

The carton may be constructed from any rigid materials, for example, cardboard, carton stock, paper board, polypropylene, polyethylene, polystyrene, ABS plastic, plastic, metal, wood, and glass amongst other suitable alternatives.

Figure 2:
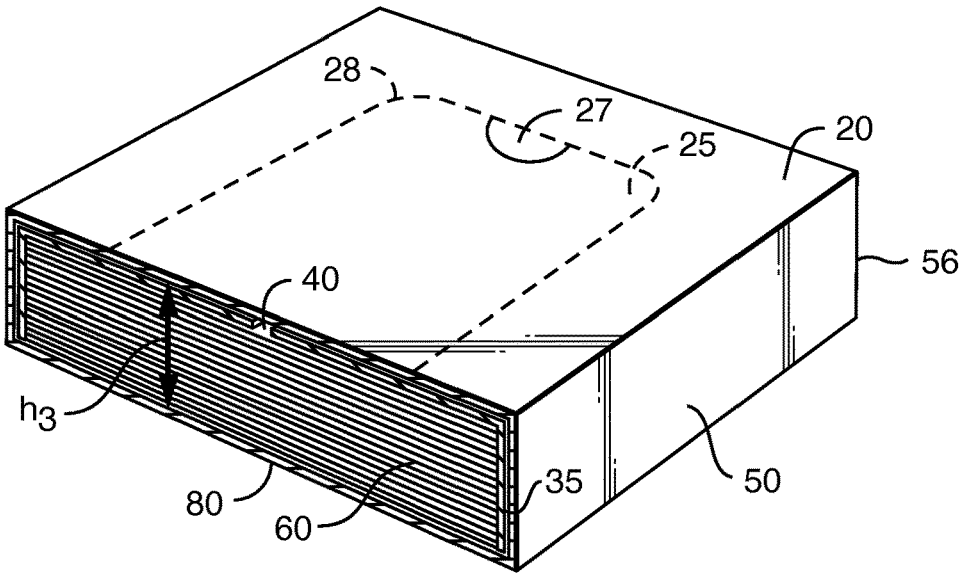
FIG. 2 illustrates a cross-section of the embodiment of FIG. 1 taken at line 1-1.

With reference to FIG. 2, which is a cross-section of the carton of FIG. 1 along the line 1-1, the stack of compressed folded tissue sheets 60 is constrained within the carton and prevented from expanding into the carton opening by the surfboard 25. During manufacturing, the stack of tissues can be separately compressed and inserted into the cartons, such as by inserting the compressed stack or clip of tissues into an open end of a carton. This is easily accomplished with sealable end flaps on the upper and lower portions of the carton as are commonly used to load partially-assembled tissue cartons with uncompressed tissue clips or stacks. In such cases, the height of the carton (H) is preferably slightly greater than the compressed height ($h_3$, defined below) of the tissue stack. The height of the carton (H) is measured between the inside surface of the top face of the carton and the inside surface of the opposing bottom face of the carton.

The initial heights of the compressed tissue stack ($h_3$) and the carton (H) may vary depending upon the number of sheets within the stack, the caliper of the individual sheets and the nature of the folding of the sheets. In general, the height of the un-compressed stack ($h_1$, discussed further below) will be from about 140 to about 220 percent of the height of the carton (H), more specifically from about 160 to about 200 percent of H, and still more specifically from about 170 to about 190 percent of H. In the compressed state, $h_3$ will be approximately equal to H or slightly less, for example from about 90 to 100 percent of H. Suitably, $h_3$ is from about 95 to about 100 percent of the height H, more specifically from about 97 to about 100 percent of H.

Figure 3:
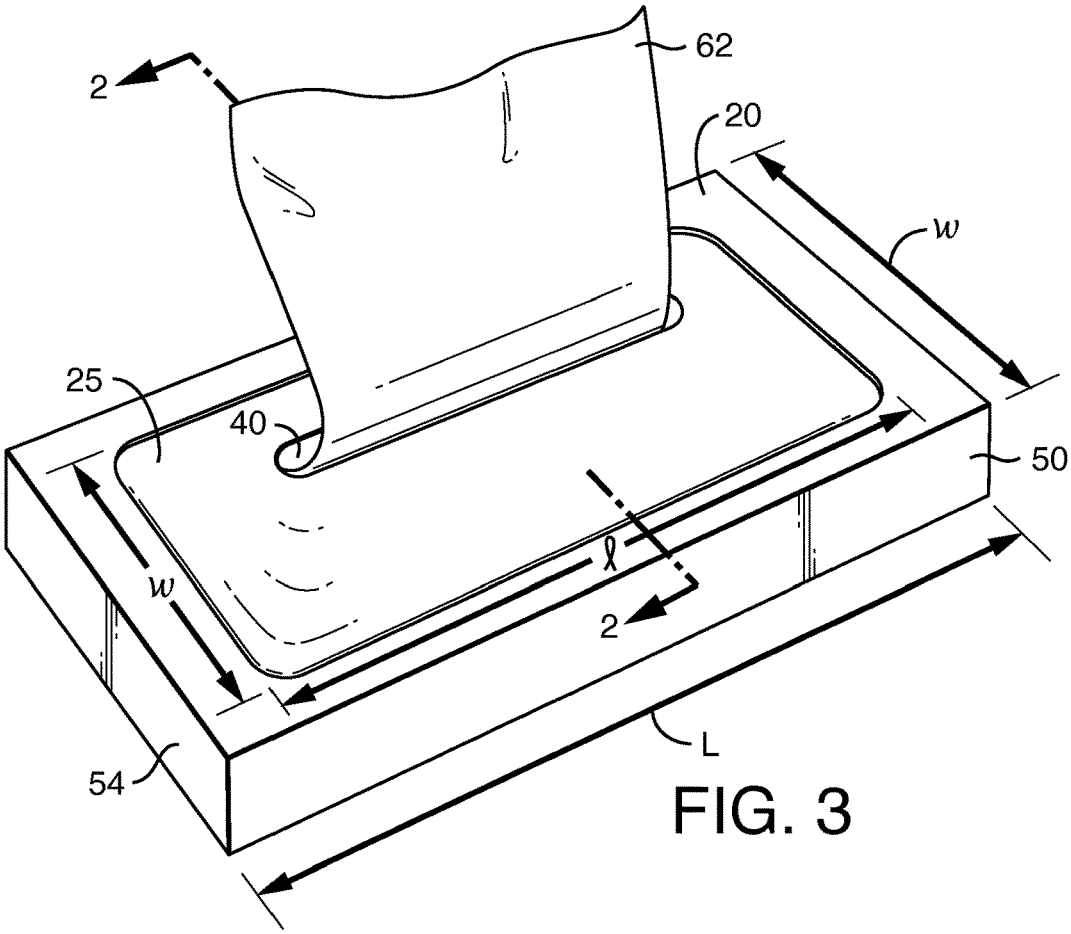
FIG. 3 illustrates a tissue carton dispenser according to another embodiment of the present disclosure.

FIG. 3 schematically illustrates the product of FIG. 1 after the user has removed the surfboard and the compressed stack of tissues has been allowed to vertically expand for dispensing the first tissue. As shown in FIG. 3, the carton 10 comprises a top panel 20, first 50 and second (not shown) sidewalls, a carton opening 30, a dispensing window 35 covering at least a portion of the carton opening 30 and a dispensing opening 40 disposed on the carton opening 30, through which the tissues 60 are dispensed. The carton 10 is preferably designed such that the carton opening 30 allows the compressed clip to decompress and expand into the opening created by the user, easing dispensing.

The relatively large surface are of the carton opening 30, relative to the top panel 20, effectively provides an area for the compressed stack of tissues to expand into when the compression of the tissues within the carton is released by removal of the surfboard. Under this condition, the expanded stack of tissues has raised the flexible dispensing window, effectively increasing the volume of the carton. In a particularly preferred embodiment, upon release of the surfboard by a user the compressed tissue stack expands from a compressed height ($h_3$) to a dispensing height ($h_4$), where the dispensing height ($h_4$) is from about 100 percent to about 150 percent greater than $h_3$. As used herein, the dispensing height ($h_4$) refers to the maximum height of the tissue stack measured after the surfboard is removed and before the first tissue dispensed. In should be noted however, that while it is preferable that the stack height expand with the release of the package compression, it is not a requirement of this invention. Therefore, in certain embodiments $h_3$ may equal $h_4$.

In those embodiments where the dispensing height ($h_4$) is greater than the height of the compressed tissue stack ($h_3$), the carton may be configured such that the total volume of the carton, and not just the stack height of the tissue stack, increases when the carton is opened. The volume of the carton generally increases as a result of the flexible dispensing window material expanding in response to pressure exerted by the stack of tissues. Thus, in certain embodiments the carton may have a volume ($V_1$) prior to removal of the surfboard and dispensing of the first tissue and second volume ($V_2$) upon removal of the surfboard and dispensing of the first tissue, such that $V_2$ is 0.1 to 5 percent greater than $V_1$ and more preferably from 0.5 to 3 percent greater than $V_1$.

According, in particularly preferred embodiments, the volume of the carton necessary to achieve satisfactory dispensing may be provided by a relatively large carton opening relative to the top panel of the carton. Thus, in one embodiment, the area of the opening 30 preferably comprises at least about 50 percent of the total area of the top panel 20. In a particularly preferred embodiment the area of the carton opening 30 comprises from about 50 percent to about 85 percent and still more preferably from about 55 percent to about 70 percent of the total area of the top panel 20. Accordingly, with reference to FIG. 2, in certain preferred embodiments the carton opening 30 is substantially rectangular and has a width (w) and a length (l), while the top panel is also substantially rectangular and has a width (W) and a length (L). In certain embodiments the width (w) of the carton opening 30 may be from about 70 to about 100 mm and the length (l) may be from about 170 to about 200 mm, while the width (W) of the top panel 20 may be from about 100 to about 130 mm and the length (L) may be from about 195 to about 235 mm.

Preferably the carton opening 30 is covered, at least in part, by a dispensing window 35. The dispensing window 35 may be selected from a moisture impervious material and more preferably from a flexible moisture impervious material that can bend or flex with minimal applied forces. Suitable flexible materials can include paper, polyethylene, polyester, polypropylene, polyvinyl chloride, polyamide, acetate, cellophane, rubber, elastomeric materials, or metal foils, amongst other suitable alternatives. The dispensing window can be a single layer, or a laminate of the above materials.

Figure 4:
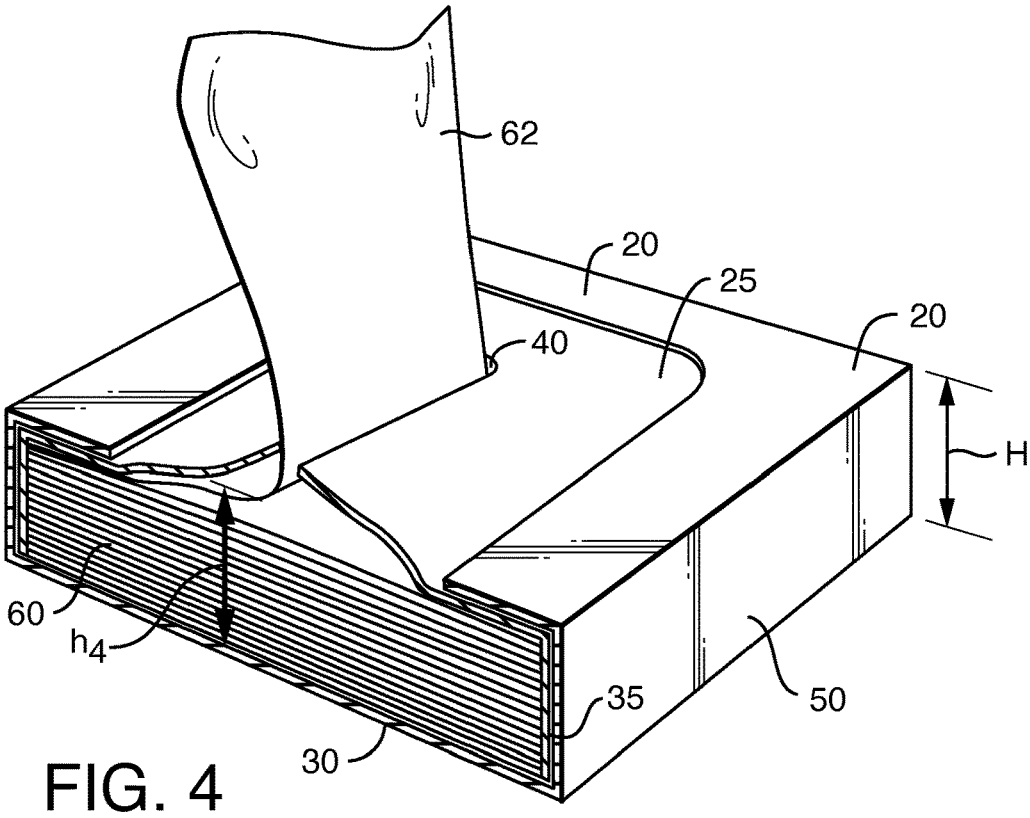
FIG. 4 illustrates a cross-section of the embodiment of FIG. 3 taken at line 2-2.

As illustrated in FIG. 4 the dispensing window 35 preferably extends beyond the interior surface of the top panel 20 to the sidewalls 50, 52. In a particularly preferred embodiment the dispensing window 35 extends the entire height of the sidewalls 50, 52. In other embodiments the dispensing window 35 may extend beyond the sidewalls 50, 52 to the bottom panel 80. The dispensing window may be attached to the top panel, one or more sidewalls, or the bottom panel, or any combination thereof.

As further illustrated in FIG. 4, the tissue 60 is dispensed through a dispensing opening 40. The dispensing opening 40 may be a simple slit in the dispensing window 35 that allows a user to access the upper most tissue in the stack. In a preferred embodiment the shape of the dispensing opening 40 is optimized to facilitate dispensing of the compressed tissues. Accordingly, in a preferred embodiment the dispensing opening 40 has a length that is about 45 to 85 percent, and more preferably about 60 to 75 percent, the length of the carton opening (l). In other embodiments the width of the dispensing opening 40 is from about 1 to about 30 mm and more preferably from about 10 to about 20 mm. Where the dispensing opening 40 has both length and width dimensions, the ends of the opening may be curved to further facilitate dispensing. In such embodiments the ends may have a radius from about 2 to about 20 mm and more preferably from about 5 to about 12 mm.

It must be noted that while the general shape of the carton 10 can be rectangular as shown; other shapes can also be employed, such as hexagonal, triangular, square and the like. Similarly, while the general shape of the top panel 20 and carton opening 30 is illustrated as rectangular, other shapes can also be employed, such as square, oval, and the like. In such cases, all that is required is that the area of the opening comprises at least about 50 percent of the total area of the top panel 20.

Accordingly, the top and bottom sidewalls of the carton can be any shape or size. Suitable shapes can include triangular, square, rectangular, pentagon, hexagon, octagon, oval, circular, star shaped or fluted. The overall size of the carton and the shape of the sidewalls can be designed as needed to properly dispense the sheet material placed within the carton. The size and shape of the carton can be influenced by the size of the sheet material being dispensed, how the sheets are folded prior to placement in the dispenser, the number of sheets placed into the dispenser, the orientation of the stack, configuration of the stack within the dispenser, and the characteristics of the material being dispensed. Often more than one acceptable shape will work to properly dispense the sheet material.

In one embodiment, the top panel and bottom panel comprised rectangles having an approximate size of 21.5 cm long by 11.5 cm wide. The sidewalls in this embodiment comprise two pairs of opposing panels attached to the top and bottom panels as illustrated in FIG. 1. The pair of opposing sidewalls have a height of approximately 3.5 cm and a length of approximately 21.5 cm. The other pair of opposing sidewalls, also referred to as end panels, comprise panels having a height of approximately 3.5 cm and a length of approximately 11.5 cm. Such a size is useful for dispensing standard size facial tissue sheets in a flat carton when folded into a stack and placed within the dispenser. The initial height of the dispenser was approximately 3.5 cm and the final height was approximately 4.2 cm, measured at its highest point, after the surfboard is removed and the carton is prepared for dispensing. With the top and bottom portions attached together, the dispenser comprised a rectangular box.

The stack of tissues may be interfolded, prefolded interfolded, or non-interfolded. As used herein, the phrase "prefolded interfolded" or "interfolded" tissues means that the tissues are folded and interleaved with neighboring tissues immediately above and/or below in the clip of tissues. The tissues can be interleaved by any suitable means, including the use of an interfolder as employed in the papermaking arts. If an interfolder is used, consecutive tissues may be attached to each other at perforation lines. In such cases, the unperforated segments of the perforation lines should be sufficiently weak to permit the consecutive tissues to separate from each other upon removal from the carton. This can be controlled by the degree of perforation of the tissue sheet. Tissues that may be employed in a non-interfolded clip which are not interleaved with neighboring tissues are releasably attached to neighboring tissues so that upon dispensing one tissue, the next adjacent tissue is ready for dispensing. Particularly preferred folding patterns include interfolding patterns that provide somewhat less friction, which tend to avoid tearing of the tissue when extracted from the container.

Webs or sheets may be folded in a stacked arrangement. Each web or sheet, when laid flat, may assume a square or rectangular shape, in many instances. Many different folds may be employed, and several embodiments of the invention are shown in the attached Figures. Folds are defined as first folds, second folds, third folds, and the like by reference to their respective position on the sheet. That is, a sheet or web having four folds, for example, typically would have a first fold, second fold, third fold, and fourth fold in that order, respectively, as when moving from one edge of the sheet to the opposite edge of that sheet.

A folded sheet, for example, would have four panels or folds and three creases. One crease appears at the junction of each fold. For example, a first crease is at the junction of the first fold and a second fold, as will be further described below. A bifolded sheet, for example, would have two folded panels and one crease, while a trifolded sheet would have three folded panels and two creases.

It should be understood that the term "web," as used herein, is meant to include a sheet material made of one or more plies of material so that a multiple-ply sheet material is considered to be a "web" of sheet material, regardless of the number of plies.

Figure 5:
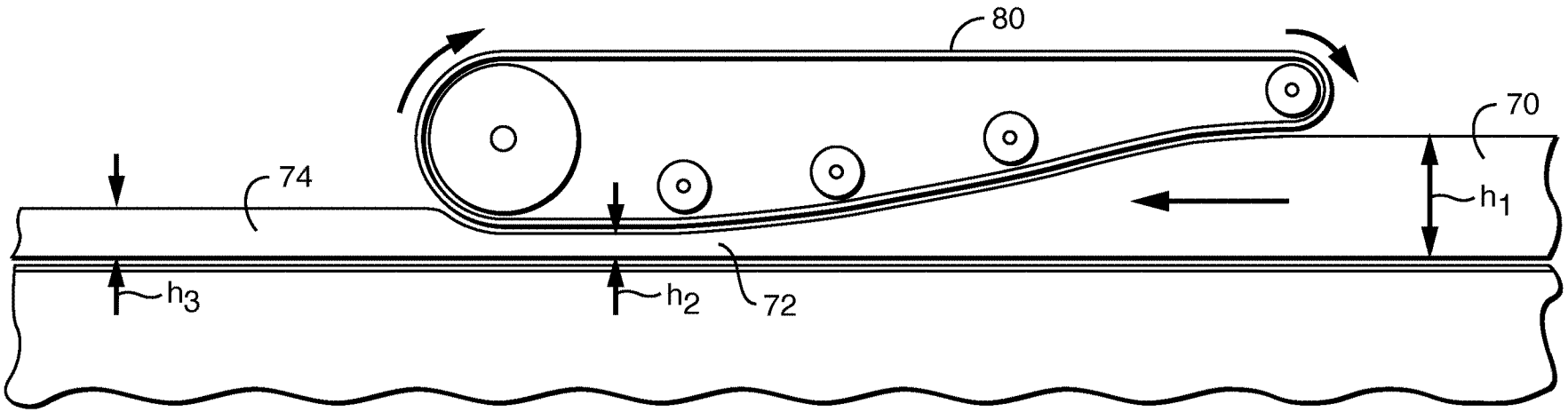
FIG. 5 illustrates one embodiment for manufacturing a compressed tissue stack.

As shown in FIG. 5, the stack of folded tissues has an initial non-compressed height ($h_1$). The stack is subjected to a compressive force, for example, by a continuous rotating belt (illustrated in FIG. 5) or by other means known in the art. The compressive force compresses the stack, reducing its height to a compressed height ($h_2$). The compressive force is then removed, allowing the stack to return to the memory compressed height ($h_3$). Preferably the compressive force is controlled so that when the user opens the carton, the stack of folded tissues is not compressed or not significantly compressed to the extent dispensing of the tissues is adversely affected.

In certain embodiments the non-compressed height ($h_1$) of the stack may be, for example, from about 45 to about 95 mm. The compressive force preferably reduces the height of the stack by about 70 to about 85 percent, such that the compressed height ($h_2$) is from about from about 1 to about 3 cm. After the compressive force is removed the stack may decompress, regaining some of its original height, such that the memory compressed height ($h_3$) is from about 30 to about 60 percent less than the non-compressed height ($h_1$). Accordingly, in certain preferred embodiments the height of the memory compressed height ($h_3$), which is loaded into the carton, may be from about 30 to about 50 mm.

Likewise, the memory compressed stack height ($h_3$) can be expressed in terms of the difference between the original uncompressed stack height ($h_1$) and the compressed stack height (h3), such that $h_1=h_3+\beta(h_3-h_2)$, where β is the recovery coefficient of the stack of tissue sheets. Thus β can be from about 0 to about 1.5, more preferably from about 0.2 to about 1, and still more preferably from about 0.3 to about 1.

Example

In order to further illustrate the invention, a tissue carton, similar to the carton illustrated in FIG. 1, having a top panel, first and second sidewalls, opposing first and second end panels, a bottom panel, a dispensing opening, and a surfboard covering a portion of the carton opening was constructed. The dimensions of the carton were as follows: height (H) 35 mm, length (L) 215 mm, width (W) 115 mm, carton opening length (l) 180 mm, and carton opening width (w) 10 mm. The carton opening was covered by a dispensing window having a dispensing opening that measured 115 mm in length and 12 mm in width and had rounded ends having a radius of 8 mm. The area of the carton opening relative to the top panel was 155.94 to 247.25 $cm^2$, or 57 percent of the area of the top panel. A comparison of the dimensions of other tissue cartons is found in the table below.

TABLE 1

| Product | Sheet Count | Total Sheet Area ($cm^2$) | Carton Volume ($cm^3$) | Top Panel Area ($cm^2$) | Carton opening Area ($cm^2$) | Opening Area: Top Panel Area |
|---|---|---|---|---|---|---|
| Example 1 | 88 | 210276 | 865 | 247.25 | 155.94 | 57% |
| Kleenex ™ Cube | 56 | 70560 | 1344 | 112 | 34.9 | 20% |
| Kleenex ™ Original | 88 | 110880 | 1825.05 | 264.5 | 76.58 | 9% |
| Kleenex ™ Mansize | 100 | 159300 | 2746 | 499.2 | 149.41 | 30% |
| Sainsbury's Basics Facial Tissue | 150 | 126000 | 1912 | 265.5 | 128.33 | 48% |
| Morrison's Regular | 150 | 126000 | 1765 | 248.64 | 65.60 | 22% |
| Morrison's Mansize | 56 | 128967 | 2417 | 503.48 | 181.43 | 36% |
| Morrison's The Best Family Tissue | 90 | 151200 | 2188 | 248.64 | 56.94 | 2% |
| Puffs ® Ultra Soft & Strong | 124 | 109874 | 2511 | 270 | 106.26 | 44% |
| Great Value ™ Facial Tissue | 110 | 97469 | 1890 | 270 | 96.25 | 36% |

The tissue carton was loaded with a compressed stack of 88 sheets of three ply tissue measuring 247.25 $cm^2$. The total sheet area (i.e., area of a tissue sheet multiplied by the number of sheets multiplied by the number of plies) was 210276 $cm^2$. The 88 sheets had an uncompressed height ($h_1$) of 6.5 cm. The stack was compressed by 78 percent to a height ($h_2$) of 1.4 cm. The compressive force was then removed and the stack was allowed to decompress to a memory compressed height ($h_3$) of 3.2 cm. The compressed clip, having a height of 3.2 cm, was then loaded into the carton.

The surfboard was removed from the top of the dispensing carton in order to dispense the tissues. Despite the stack of tissues being compressed dispensing was achieved without tearing the tissues.

A carton volume reduction of approximately 53 percent was achieved compared to traditional cartons used to dispense similar sized non-compressed tissue. Cardboard packaging required was reduced by 28 percent. As a result, the cost savings associated with the material and shipping costs for such a product would be significant.

It will be appreciated that the foregoing example, given for purposes of illustration, is not to be construed as limiting the scope of the invention, which is defined by the following claims and all equivalents thereto.

We claim:

1. A carton comprising:

a. a top face and a bottom face extending inwardly from a first and a second sidewall, the top face comprising a top face surface area a top panel having an interior surface and a removable surfboard, the top panel comprising from about 15 to about 50 percent of the top face surface area;

b. a carton opening located in the top panel; and c. a dispensing window disposed adjacent to at least a portion of the interior surface of the top panel and covering at least a portion of the carton opening, the dispensing window having a dispensing opening disposed thereon; wherein the area of the carton opening is from about 50 percent to about 85 percent of the area of the top face surface.

2. The carton of claim 1 wherein the first and second sidewall have an interior surface and a height and wherein the dispensing window is disposed adjacent to at least a portion of the interior surface of the first or second sidewall.

3. The carton of claim 2 wherein the dispensing window extends the entire height of the first or second sidewall.

4. The carton of claim 1 wherein the dispensing window is disposed about the entire interior surface of the carton opening.

5. The carton of claim 1 further comprising a stack of tissues disposed in the carton.

6. The carton of claim 5 wherein the stack of tissues comprises a compressed stack of tissues, the compressed stack of tissues having a compressed height (h3) that is from about 30 percent to about 60 percent less than the height of an identical uncompressed stack of tissues (h1).

7. The carton of claim 6 wherein the height of the carton (H) is from about 0 to about 15 percent greater than the height of the compressed stack of tissues (h3).

8. The carton of claim 1 wherein the dispensing opening has a width from about 10 to about 20 mm.

9. The carton of claim 1 wherein the top panel has a length (L) and the dispensing opening has a length (l) that is from about 60 to about 75 percent of the length (L).

10. The carton of claim 8 wherein the dispensing opening has first and second ends, the first and second ends being substantially curved.

11. The carton of claim 1 wherein the area of the carton opening is from about 55 percent to about 80 percent of the area of the top panel.

12. The carton of claim 1 wherein the dispensing window is formed from a flexible material selected from the group consisting of paper, polyethylene, polyester, polypropylene, polyvinyl chloride, polyamide, acetate and laminates thereof.

13. A carton for dispensing a compressed stack of tissues comprising:

a. A top face having a surface area and comprising a top panel having an interior surface, the top panel comprising from about 15 to about 50 percent of the top face surface area;

b. a carton opening disposed on the top panel, the carton opening having an area that is from about 50 percent to about 85 percent of the area of the top face;

c. a pair of side panels;

d. a flexible dispensing window disposed about an entire periphery of the carton opening, the window further attached to the interior surface of the top panel and a portion of at least one side panel;

e. a dispensing opening disposed on the dispensing window, the dispensing opening having a width from about 10 to about 15 mm and a length from about 60 percent to about 80 percent of the length of the carton opening;

f. a removable surfboard overlaying at least a portion of the dispensing window;

g. a compressed stack of tissues; and h. a bottom face.

14. The carton of claim 13 wherein the compressed stack of tissues has a compressed height (h3) that is from about 30 percent to about 60 percent less than the height of an identical uncompressed stack of tissues (h1).

15. The carton of claim 13 wherein the dispensing window is attached to at least one side panel.

* * * * *